US010881901B2

(12) United States Patent
Taivainen et al.

(10) Patent No.: US 10,881,901 B2
(45) Date of Patent: Jan. 5, 2021

(54) REHABILITATION DEVICE AND ITS USE FOR EXERCISING THE SHOULDER REGION

(71) Applicant: DAVID HEALTH SOLUTIONS LTD., Helsinki (FI)

(72) Inventors: Tapio Taivainen, Outokumpu (FI); Johannes Hautamäki, Espoo (FI); Arno Parviainen, Helsinki (FI)

(73) Assignee: DAVID HEALTH SOLUTIONS LTD., Helsinki (FI)

( * ) Notice: Subject to any disclaimer, the term of this patent is extended or adjusted under 35 U.S.C. 154(b) by 83 days.

(21) Appl. No.: 16/090,978

(22) PCT Filed: Apr. 3, 2017

(86) PCT No.: PCT/FI2017/050236
§ 371 (c)(1),
(2) Date: Oct. 3, 2018

(87) PCT Pub. No.: WO2017/174872
PCT Pub. Date: Oct. 12, 2017

(65) Prior Publication Data

US 2019/0111312 A1 Apr. 18, 2019

(30) Foreign Application Priority Data

Apr. 4, 2016 (FI) ..... 20165286

(51) Int. Cl.
*A63B 23/12* (2006.01)
*A63B 24/00* (2006.01)
(Continued)

(52) U.S. Cl.
CPC ..... *A63B 23/1245* (2013.01); *A63B 21/4033* (2015.10); *A63B 21/4039* (2015.10);
(Continued)

(58) Field of Classification Search
CPC ..... A63B 23/1245; A63B 23/0233; A63B 21/4047; A63B 24/0087; A63B 24/0062; A61H 1/00281; A61H 2001/0203
See application file for complete search history.

(56) References Cited

U.S. PATENT DOCUMENTS 5,171,198 A 12/1992 Jones
5,179,939 A 1/1993 Donovan et al.
(Continued)

FOREIGN PATENT DOCUMENTS

CN 204092497 U 1/2015
JP 2009-268839 A 11/2009
(Continued)

OTHER PUBLICATIONS

Supplementary European Search Report issued in courterpart EP application No. 17 77 8734, dated Oct. 18, 2019.
(Continued)

*Primary Examiner* — Jennifer Robertson
(74) *Attorney, Agent, or Firm* — Charles C. Achkar; Ostrolenk Faber LLP.

(57) ABSTRACT

The present invention relates to a rehabilitation device adapted for rehabilitating and/or exercising the shoulder region, as well as to the use of such a rehabilitation device. The rehabilitation device has support elements (3, 4, 5) enabling the upright position of the upper body during the exercise, two motion shafts (2) guiding the motion in a pre-defined direction of motion, and two handleless arm supports (1) attached to the end of each motion shaft and arranged to support the arms of the user, preventing activation of the muscles carrying the arm.

5 Claims, 2 Drawing Sheets

Figure 1:
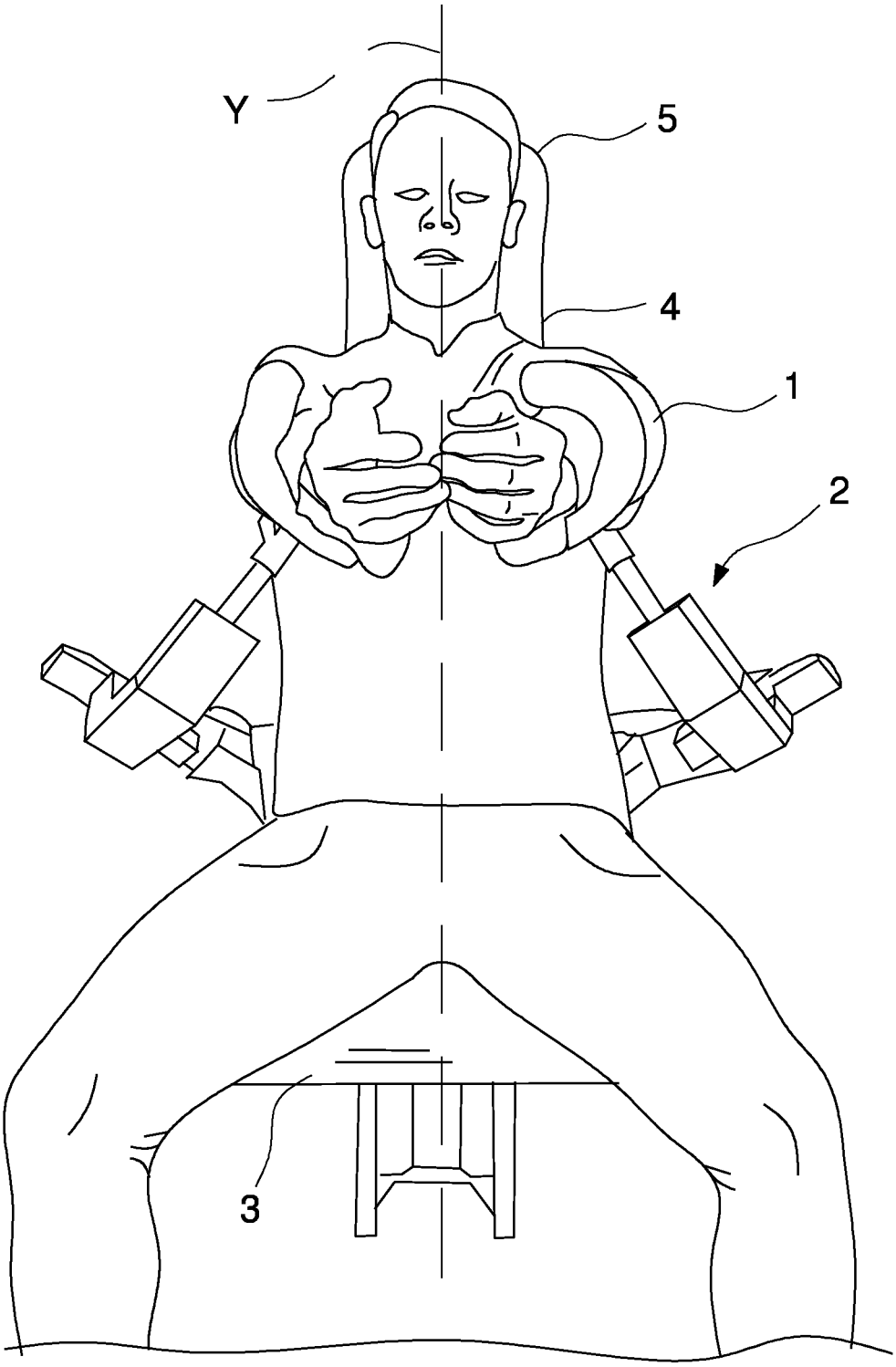

(51) Int. Cl.

| | |
|---|---|
| ***A63B 21/00*** | (2006.01) |
| ***A63B 21/005*** | (2006.01) |
| ***A63B 21/008*** | (2006.01) |
| ***A63B 22/00*** | (2006.01) |
| ***A63B 21/062*** | (2006.01) |

(52) U.S. Cl.

CPC ..... *A63B 21/4047* (2015.10); *A63B 24/0087* (2013.01); *A63B 21/005* (2013.01); *A63B 21/00072* (2013.01); *A63B 21/0083* (2013.01); *A63B 21/0628* (2015.10); *A63B 21/154* (2013.01); *A63B 2022/0094* (2013.01); *A63B 2208/0233* (2013.01); *A63B 2220/24* (2013.01); *A63B 2220/51* (2013.01); *A63B 2225/09* (2013.01); *A63B 2225/096* (2013.01); *A63B 2225/50* (2013.01); *A63B 2225/54* (2013.01)

(56) References Cited

U.S. PATENT DOCUMENTS

| | | | | |
|---|---|---|---|---|
| 5,409,438 | A * | 4/1995 | Jones | A63B 21/0615 482/100 |
| 7,833,138 | B1 | 11/2010 | Fulks | |
| 2004/0209746 | A1 | 10/2004 | Spiegel | |
| 2012/0040799 | A1 | 2/2012 | Jaquish et al. | |
| 2014/0158839 | A1 | 6/2014 | Doyle | |
| 2015/0335951 | A1* | 11/2015 | Eder | A63B 24/0062 482/9 |

FOREIGN PATENT DOCUMENTS

| | | | |
|---|---|---|---|
| JP | 2014-172129 | A | 9/2014 |
| WO | WO 8501446 | A1 | 4/1985 |
| WO | WO 2004110565 | A1 | 12/2004 |
| WO | WO 2011104320 | A1 | 9/2011 |
| WO | WO 2015/048688 | A1 | 4/2015 |
| WO | WO 2015/147584 | A1 | 10/2015 |

OTHER PUBLICATIONS

International Search Report issued in International Application No. PCT/FI2017/050236, dated Sep. 8, 2017.

Written Opinion of the International Searching Authority issued in International Application No. PCT/FI2017/050236, dated Sep. 8, 2017.

Finland Search Report issued in priority application No. 20165286, dated Nov. 3, 2016.

International Preliminary Report on Patentability issued in International Application No. PCT/FI2017/050236, dated Apr. 25, 2018.

* cited by examiner

REHABILITATION DEVICE AND ITS USE FOR EXERCISING THE SHOULDER REGION

CROSS REFERENCE TO RELATED APPLICATIONS

The present application is a § 371 National Phase application based on PCT/FI2017/050236 filed Apr. 3, 2017, which claims the benefit of Finland application No. 20165286 filed Apr. 4, 2016, the subject matter of each of which are incorporated by reference in their entirety.

The present invention relates to a device adapted for rehabilitating and/or exercising the shoulder region to prevent, ease and/or heal pains in the shoulder region.

Shoulder pain is a formidable problem worldwide. Of all musculoskeletal problems, shoulder ailments cause the most sick leave absences. Shoulder pain is the most common musculoskeletal ailment in persons over 65 years of age and its prevalence has tripled during the last 40 years. One in every two persons will experience shoulder pains during their lifetime. In spite of these figures, rehabilitating and exercising the shoulder measurably, monitorably and repeatably by a biomechanically optimal method has not been possible.

For pain patients suffering from shoulder impingement, there often prevails a significant muscle imbalance between the muscles moving the scapula in different directions and stabilizing it. Some of these muscles are therefore weak and some are, in turn, overactive. In this case, the exercises used in rehabilitation must be planned to activate the musculature such that the repair of the muscle imbalance is enabled. For example, an overactivity of the upper portion of the trapezius muscle (*musculus trapezius*) is typical in shoulder pain patients. Thus, an attempt must be made by an exercise to activate the middle and lower portions of the trapezius without the upper portion being significantly activated. Muscle imbalance also occurs quite often in the three-headed deltoid muscle (*musculus deltoideus*). Its front and middle portions are often considerably more developed in comparison to the rear portion of the muscle. The repair of this muscle imbalance is also important.

Exercising the middle and lower portions of the trapezius without activating the upper portion is enabled by removing the activation of the trapezius carrying the arm. In physiotherapy, the exercise is generally executed while lying on the stomach, wherein the upper portion of the trapezius does not need to carry the hand in opposition to gravity. According to research, excellent activation of the middle and lower portions of the trapezius is achieved by the so-called "overhead arm raise" exercise, in the start position of which the patient lies on his stomach on the treatment table or an adequately high bench such that the hand to be exercised hangs directly down towards the ground. The hand is raised to the side (horizontal abduction) and slightly forwards, wherein, in the end position, the arm forms a 125 degree angle with the body (as viewed from above/the back side). In this exercise, the exercise load created by the hand or a possible small hand weight is, as the lever arm increases, at its greatest in the end position, but the force production curve of the muscles to be exercised is completely opposite in comparison to the load curve. Thus, the exercise response produced by the exercise is far from optimal, as the magnitude of the exercise load can be, at its maximum, as great as the force production of the muscles to be exercised in the end position of the motion. The load is thus not adequate over the entire motion range and the effectiveness of the exercise is not optimal.

The trapezius is typically exercised with a variety of pulling motions, in which rubber resistance bands, pulleys, various gym devices or free weights can be used as the resistance. The variations are innumerable. With the exception of well-designed devices, the above said exercise forms do not produce an optimal load curve.

In order that the so-called "overhead arm raise" exercise can be performed with the body in the upright position, the arms must be supported from below such that no muscle activation is needed to carry them. Activation of the upper portion of the trapezius is thus avoided. The motion must further be directed slightly to the upper oblique, wherein the direction of the motion is closer to the orientation of muscle cells of the lower portion of the trapezius and better activation is achieved in the lower portion. The above said characteristics are not found in the exercise devices on the market. Using the so-called TRX straps, in which the weight of the user's own body functions as the load, the exercise described above (the Y-raise) can be implemented with high quality. However, due to the numerous degrees of freedom, TRX straps are not suitable for persons unfamiliar with the exercise, because executing the motion with TRX straps requires good body coordination and centre body control, and their correct use requires expert guidance and numerous exercise sessions.

From CN204092497U is prior known a device having two motion shafts and two mobile arm holders having straps to be tied.

From U.S. Pat. No. 5,179,939A is prior known a device, in which the arm holder is articulated to the motion shaft.

From U.S. Pat. No. 5,171,198 is further prior known a device, in which the axes of the motion shafts are to be tilted.

The object of the present invention is to obviate above said disadvantages and provide a rehabilitation device, by means of which rehabilitation or exercise of the shoulder region can be directed with optimal load into the desired muscles and/or portions of muscles, the exercise taking place while seated in the upright position.

This object can be achieved by using a rehabilitation device according to the invention, to which are arranged support elements enabling the upright position of the upper body of the rehabilitation device user while executing the exercise, and to which are arranged handleless arm supports supporting the arms of the user such that the muscles or portions of the muscles that carry the arms do not activate, and in which the motion of the exercise is enabled only in such a direction, in which the desired muscles or portions of the muscles are activated by moving the arm supports and the motion shafts.

More specifically, a rehabilitation device according to the invention is characterized by that, which is specified in the characterizing part of claim 1. The use of a device according to the invention for exercising the shoulder region is, in turn, characterized by that, which is specified in the characterizing part of claim 8.

Figure 2:
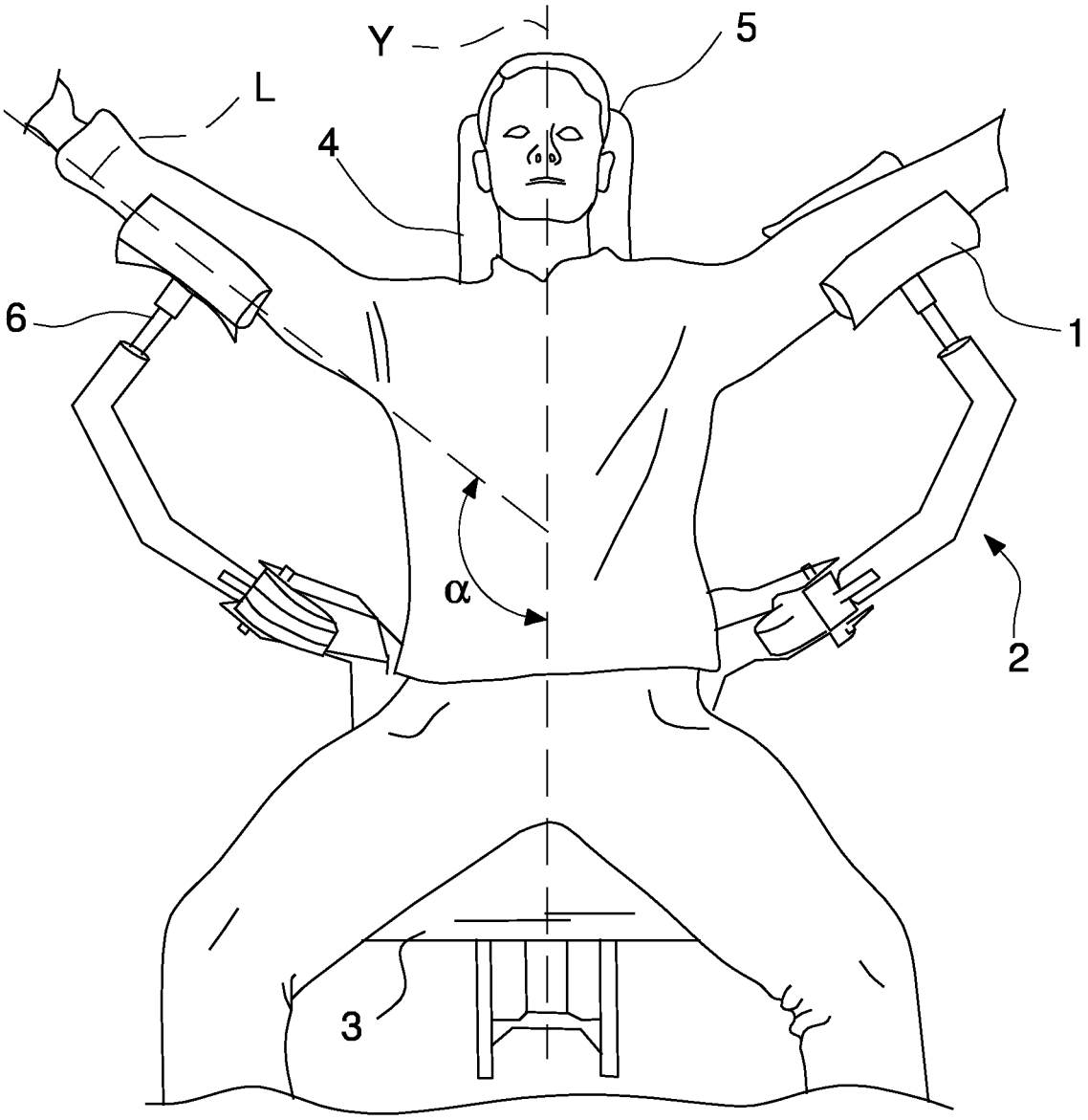

In the following, the present invention is described in more detail by means of reference to the following drawings, in which:

FIG. 1 shows a device according to a preferred embodiment of the invention in the start position of the rehabilitation exercise; and FIG. 2 shows a device according to the preferred embodiment of FIG. 1 in the end position of the rehabilitation exercise.

The user of the device of a preferred embodiment of the invention, shown in FIGS. 1 and 2, sits during the exercise on a seat 3, leaning against the backrest 4 and the headrest 5. The device includes, attached to the ends of the motion shafts 2, handleless arm supports 1, into which the user settles his arms, and by moving which the exercise is executed. The arm supports 1 are connected to the motion shafts 2 preferably by articulation 6, wherein the arm supports 1 can be moved in relation to the motion shafts 2 such that they are suitable for arms of various models and sizes. In a preferred embodiment, the arm support 1 is able to rotate around the axis of the joint 6 and thus to settle into the correct position depending on the shape of the arm.

In this invention, by the term handle is meant all such elements, means or parts of devices or corresponding, onto which can be grasped by the palm and/or fingers during execution of the exercise. By the term arm support is, in turn, meant a device intended for supporting the arm (forearm and upper arm).

The exercise is executed on a device according to the preferred embodiment while seated leaning slightly backwards. The height of the seat is preferably adjusted electrically. The seat 3 is preferably attached directly to the device, but the seat can be arranged in connection with the device also separately from the frame. The backrest is designed such that it does not limit the movement of the shoulder blades. The role of the headrest is important due to the backwards leaning position.

The arms are placed into the arm supports in the motion shafts, the arm supports carrying the arms preferably such that the elbow is as close to the centre of the arm support as possible. Preferably, the arm support supports the arm in a region extending approximately from the middle of the forearm approximately to the middle of the upper arm. The arm is in a substantially straightened position during the entire exercise. In the start position (FIG. 1), the arms being straightened in front, the angle between the forearm and the body is preferably 80-90 degrees depending on the thickness of the forearm. This is achieved by arranging each arm support to the end of the motion shaft such that the angle between the longitudinal axis L of the arm support and the transverse plane perpendicular in relation to the plane Y travelling through the vertical midline of the device is approximately 80-90 degrees. The device has no handles, rather force is transmitted via the arm supports in the motion shafts, wherein the motion can be executed while the upper arm is in external rotation. Optimally, the upper arm is in external rotation during the exercise, thus effectively activating also the supraspinatus muscle (*M. supraspinatus*) of the rotator cuff. If external rotation causes pain to a shoulder patient, the rotation of the upper arm can be kept neutral.

Supporting the arms by handleless arm supports is extremely important for the exercise in order that the muscles carrying the hands (i.a. the upper portions of the trapezius) do not activate. Using rubber bands, pulleys or free weights this is not possible in the upright position. The supports are designed such that it is easy to settle the arms on top of the supports. The design of the arm supports enables the production of force only in the desired direction, eliminating the activation of undesired muscles.

The motion is executed by taking the arms from the start position to the side, slightly to the upper oblique. Although the trajectory of the motion is directed slightly to the upper oblique, the design of the arm supports prevents the production of upward force. Specifically, the supports are designed such that the motion cannot be produced by activating undesired muscles. For example, activation of the upper portion of the trapezius cannot thus produce force in the direction of the motion.

In the end position of the exercise (FIG. 2), the arm forms with the body a 120-130 degree, and preferably a 125 degree angle. This is achieved by arranging the arm supports in the end position such that their longitudinal axes L form with a plane travelling through the vertical midline Y of the device an approximately 120-130 degree angle $\alpha$, preferably a 125 degree angle. A direction of motion that is unique and important for the exercise is created by tilting the axes of the motion shafts inwards, which enables a trajectory directed to the upper oblique.

The precisely designed arm supports of the motion shafts remove the muscle activation of the muscles carrying the arms. In the process, the shoulder joint is left with more space to move and a seemingly difficult motion is enabled also for shoulder pain patients. The design of the arm supports eliminates the activation of undesired muscles, because force can be produced only in the desired direction. Secondly, having no handles enables a painless exercise position for sore shoulders, because the rotation of the upper arm can be freely selected. Also, exceptionally important when rehabilitating sore shoulders is a precisely planned load curve, which enables the motion to be executed in a controlled manner over the entire motion range.

An attempt has been made to minimize the number of adjustments affecting the exercise position and they are preferably adjusted automatically by means of an electric motor. To the device are preferably arranged means for transmitting the pre-stored information about the user to an apparatus, as well as means for automatically adjusting at least one support element, motion shaft, arm support, load or other part of the device on the basis of the stored information.

The exercise information of the user, such as the exercise position adjustment information, number of series, repetitions, the motion range (starting and ending angle), the load and the execution speed of the motion, is stored in the memory of the device, or preferably in a cloud service, or in another corresponding external memory of the device, from which the exercise information is retrieved on the basis of the identification of the user, for example, as the user signs into the exercise device using a RFID card.

To the device are preferably also arranged means for collecting information about the exercise, as well as means for storing the information. Preferably, the information regarding an execution can be collected, for example, approx. 50 times per second via the force and angle sensors. Using this information, isometric measurements can be performed, which are useful for diagnostics as well as for monitoring rehabilitation. The information is stored in the memory in the device, or preferably in a cloud service or a corresponding external memory of the device.

As the load, the device preferably has a weight stack comprised of weight slabs. Such a weight stack is per se entirely prior known, and it is not presented in more detail in this connection. The load is transmitted into the motion shafts via force transfer. A substantial portion of the force transfer is a so-called cam (not shown), due to which the magnitude of the load changes as the motion shaft moves. The cam is preferably located within the weight stack frame. A cam designed with extremely great precision enables the safe, controlled and efficient exercise over the entire motion range. The load to be used in the exercise is selected by moving the selection peg of the weight stack, placing it between the weight slabs into the desired site. Also other type of solutions well known in the field can be considered for use as the load, such as a hydraulic or electrical resistance.

By using a device according to the invention, exercise of the muscles stabilizing the scapula towards the spine as well as of the rear portion ("deltoid posterior head") of the three-headed deltoid muscle (*M. deltoideus*), which significantly participates in the execution of the motion, is safe and effective. Due to the optimal load curve, joint angles and arm supports, the exercise is directed with great precision into the desired muscles, while preventing activation of undesired muscles or portions of muscles. Joint angles and motion directions are defined on the basis of an extensive review of the literature as well as of our own measurements.

Adjustment of the starting angle of a motion is performed by means of a lever above the weight stack. Squeezing the lever and moving it up or down enables adjusting the length of the cable, which transmits the force to the weight stack. Thus, the motion shafts also move and, when the squeezing of the lever is released, the motion shafts lock and define thus the starting angle of the motion. Such a lever is per se prior known, and it is not presented in more detail in this connection.

In order for the exercise to be safe, comfortable and effective, the line of the axis of the motion shaft must travel though the pivot point of the shoulder joint. Due to the movement of the shoulder blade, the pivot point of the shoulder joint is, however, not located in the joint cavity, rather slightly in the medial direction from the joint, closer to the vertical midline of the body. This is an exceptionally important characteristic for the correct biomechanics of the exercise.

The invention claimed is:

1. A rehabilitation device adapted for rehabilitating a shoulder region of a user, the rehabilitation device comprising:

a frame;

support elements coupled to the frame and configured to enable an upright position of an upper body of the user during a rehabilitation exercise;

two motion shafts configured to guide motion of an arm of a user in a pre-defined direction, and wherein the motion shafts are arranged such that an axis of each motion shaft is arranged to tilt inwards toward a plane (Y) passing through a centerline of the rehabilitating device;

two handleless arm supports attached to an end of each motion shaft, configured to carry arms of a user, and configured to support the arms of a user;

wherein the device is configured so that at the beginning of a rehabilitation exercise, each arm of a user is in a position straightened forward in front of the user at a 80 to 90 degree angle from the body of the user; and wherein the device is configured so that at an end position of the rehabilitation exercise each arm of a user has been moved to a position wherein the arm forms a 120 to 130 degree angle $\alpha$ with a plane travelling through a vertical midline of the device.

2. A rehabilitation device according to claim 1, wherein the arm supports of the motion shafts are arranged to be suitable for various models and sizes of arms.

3. A rehabilitation device according to claim 2, wherein the arm supports of the motion shafts are articulated to the motion shafts such that the arm supports are movable in order to suit various models and sizes of arms.

4. A rehabilitation device according to claim 1, wherein information containing personal information of each user for adjusting the device is stored in a cloud service.

5. A method of exercising the shoulder region on the user of the rehabilitation device according to claim 1, the method comprising the steps of positioning the arms of the user into the arm supports; using the user's arms for moving the user's arms in the arm supports of the device along a pre-defined trajectory, wherein the arm supports carry the user's hands from a first position, wherein each arm of the user is in a position straightened forward in front of the user at a 80 to 90 degree angle from the body of the user; and to a second position wherein at an end position of the rehabilitation exercise each arm of the user has been moved to a position wherein the arm forms a 120 to 130 degree angle $\alpha$ with a plane travelling through a vertical midline of the device, whereby activation of the muscles carrying the arms is prevented.

* * * * *